United States Patent [19]

Erwien et al.

[11] 4,176,884

[45] Dec. 4, 1979

[54] ANCHORING APPARATUS FOR A MINING INSTALLATION

[75] Inventors: Helmut Erwien, Lunen; Werner Karsten, Gelsenkirchen, both of Fed. Rep. of Germany

[73] Assignee: Gewerkschaft Eisenhutte Westfalia, Fed. Rep. of Germany

[21] Appl. No.: 873,223

[22] Filed: Jan. 30, 1978

[30] Foreign Application Priority Data

Feb. 3, 1977 [DE] Fed. Rep. of Germany ..... 2704495

[51] Int. Cl.[2] ..... E21C 29/08

[52] U.S. Cl. ..... 299/34; 299/43

[58] Field of Search ..... 299/34, 42–48

[56] References Cited

U.S. PATENT DOCUMENTS 3,718,368 2/1973 Rassmann et al. ..... 299/34

FOREIGN PATENT DOCUMENTS 976949 8/1964 Fed. Rep. of Germany ..... 299/34

1231652 1/1967 Fed. Rep. of Germany ..... 299/34

2201643 7/1973 Fed. Rep. of Germany ..... 299/43

*Primary Examiner*—Ernest R. Purser

*Attorney, Agent, or Firm*—Thompson, Birch, Gauthier & Samuels

[57] ABSTRACT

Apparatus for anchoring a mining installation to the floor of a mine working includes an anchor beam and means for anchoring the anchor beam. A trolley is mounted on the anchor beam for longitudinal movement relative thereto. A guide skid is pivotally connected, at one end, to the trolley and one end of a support skid is pivotally connected to the other end of the guide skid. The other end of the support skid is pivotally connected to a support table for the mining installation, whereby the support table can pivot in a vertical plane. A support strut pivotally connected to both the guide skid and the support table holds the support table firmly at a given inclination.

15 Claims, 1 Drawing Figure

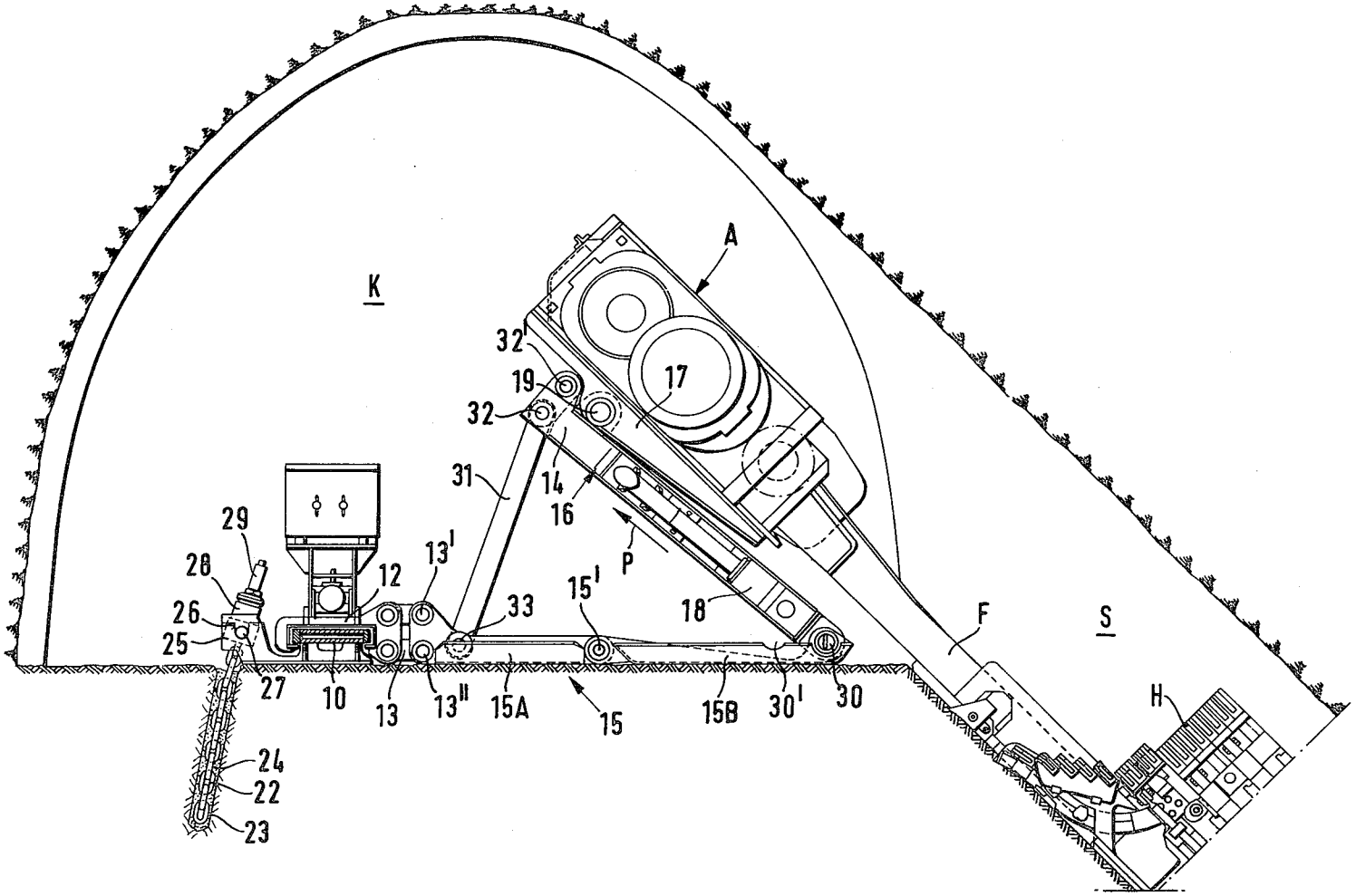
A
17
32'
19
32
31
14
16
P
18
F
S
H
30
30'
15B
15'
15
15A
33
13'
13''
13
12
10
K
27
29
28
26
25
24
22
23

ANCHORING APPARATUS FOR A MINING INSTALLATION

BACKGROUND TO THE INVENTION

This invention relates to anchoring apparatus for anchoring a mining installation to the floor of a mine working.

A known form of anchoring apparatus for anchoring the drive head of a longwall mining system has a support table provided with skids and pivotally connected by means of a double-link joint to a trolley guided on an anchor beam. The anchor beam is anchored to the floor of the working by means of tie bolts fixed in bores in the floor. An anchor plate is mounted on the support table by means of a pivot joint, the anchor plate carrying the drive head. In order to tension the installation, bracing rams are provided on the support table, the rams acting on the anchor plate which can be displaced in relation to the skid understructure of the support table.

The aim of the invention is to provide an anchoring apparatus of this type which is usable in a head gallery for anchoring a drive head, and which can easily be adapted to different operating conditions, especially to the inclination of the face to be won, to the inclination of the seam, and also to irregularities in the floor of the working, whilst maintaining reliable anchoring and tensioning of the drive head and without harmful bending and deformation forces being introduced into the installation.

SUMMARY OF THE INVENTION

The present invention provides apparatus for anchoring a mining installation to the floor of a mining working, the apparatus comprising an anchor beam, means for anchoring the anchor beam to the floor, a trolley mounted on the anchor beam for longitudinal movement relative thereto, a guide skid pivotally connected to the trolley, a support skid pivotally connected to the guide skid, a support table for supporting the mining installation the support table being pivotally connected to the support skid for pivotal movement in a vertical plane, and a support strut pivotally connected to the support table and the guide skid.

Thus, this apparatus permits a mining installation, such as a drive head, to be pivoted in a vertical plane relative to the skid understructure, whereby the installation can be adjusted to different inclinations of the working. Moreover, the effective division of the skid into a guide skid and a support skid pivotally connected thereto, enables the apparatus to adapt itself to irregularities in the floor of the working whilst ensuring a large area of support.

Advantageously, the means for anchoring the anchor beam is constituted by a plurality of tie bolts each of which is anchorable in a respective bore in the floor.

Preferably, the support table is provided with a carriage which is longitudinally displaceable relative thereto by at least one bracing ram, the carriage being connected to an anchor plate which supports the mining installation and is pivotally connected thereto.

The guideskid may be pivotally connected to the trolley by means of a double-link pivot joint.

Advantageously, one end of the support strut is pivotally connected to the guide skid by means of a pivot joint positioned adjacent to the pivotal connection between the guide skid and the trolley, and the other end of the support joint is pivotally connected to the support table by means of a pivot joint situated at one end of the support table. In this case, the support skid may be pivotally connected to the support table by means of a pivot joint situated at the other end of the support table.

In order to vary the angle of the support table, a plurality of attachment points may be provided on the support table and/or the guide skid for pivotal connection to the support strut.

Preferably, the length of the support table is substantially the same as the combined lengths of the guide skid and the support skid.

The apparatus apparatus according to the invention can also be used in level workings and in normal longwall workings. In this case, the support strut can be removed and the support table lowered so as to rest on the guide and support skids. In order to strengthen this assembly, the support table may be bolted down to the guide skid. Alternatively, said one end of the support table may be provided with an attachment point for pivotal connection to the trolley.

In this case, the support skid may be provided with a plurality of spaced attachment points for pivotal connection to the support table, whereby the support table can be fastened to the trolley and to the support skid whilst lying on top of the two skids. Alternatively, the two skids could be removed in such a situation and the support table fastened to the trolley.

BRIEF DESCRIPTION OF THE DRAWING

One form of apparatus for anchoring a mining installation and constructed in accordance with the invention will now be described, by way of example, with reference to the accompanying drawing, the single FIGURE of which is a side elevation of the anchoring apparatus positioned in a head gallery at the end of a longwall working face.

DESCRIPTION OF PREFERRED EMBODIMENT

Referring to the drawing, the anchoring apparatus serves to anchor and brace the drive head A of a conveyor and winning installation, especially a coal plough installation, within a head gallery K which is formed at one end of an inclined longwall working face S. The winning of the coal from the longwall face S takes place, in known manner, by means of a coal plough H which is guided longitudinally along a longwall conveyor F. At the head end of the conveyor, a drive frame (not shown) is attached, a conveyor drive system and a plough drive system being mounted on the drive frame. The drive frame, together with the associated drive systems, forms the drive head A.

In order to anchor and brace the conveyor and the winning installation, an anchor beam 10 is provided in the head gallery K. The anchor beam 10 is constituted by a plurality of individual, detachably interconnected, beam sections which can be removed individually at the rear end of the anchor beam as the longwall face advances and attached again at the foward end of the beam. A trolley 12 is slidably mounted on the anchor beam 10 for displacement in the longitudinal direction of the beam, that is to say along the longwall face S. The trolley 12, which grasps the anchor beam 10 from above, is joined by a pair of articulated links 13, in a tension-proof manner, to a skid 15 of a drive frame support table 16. The skid 15 is slidably supported on the gallery floor, and is divided by an intermediate articulated joint 15', whose pivot axis is horizontal, so as to constitute a guide skid 15A and a support skid 15B. The guide skid 15A is, thus, connected to the trolley 12 for pivotal movement in the vertical plane by means of the double joint 13 at its side remote from the intermediate joint 15'.

The free end of the support skid 15B is connected to the support table 16 for pivotal movement in a vertical plane by means of a pivot joint 30. The support table 16 is inclined in relation to the skid 15 approximately at the angle of inclination of the dip of the gallery. The table 16 is held at the required angle by means of at least one support strut 31, one end of which is pivotally connected to the raised end of the support table by means of a head joint 32, the other end being pivotally connected to the guide skid 15A by means of a foot joint 33. The foot joint 33 is positioned adjacent to the double joint 13 which connects the skid 15 to the trolley 12.

A carriage 14 is displaceably guided in the bracing direction P on the support table 16 and carries an anchor plate 17 which is pivotally connected, by means of a pivot joint 19, to the carriage. The pivot joint 19 thus permits limited adjustment of the drive head A to conform with the angle of dip of the longwall face S. The displacement of the carriage 14, and thus the bracing of the drive head A, is effected by means of hydraulic bracing rams 18 which are interposed between the support table 16 and the carriage.

Each of the joints 30, 32 and 33 is preferably formed as a disengageable joint having, for example, a bolt passing through eyes in the members being joined. The spacing between the joints 30 and 32 is preferably equal to the spacing between the joints 30 and 33. If the support strut 31 is removed, the support table 16 can be pivoted down on to the skid 15, the part of the joint 32 on the support table and the part of the joint 33 on the guide skid 15A coming into alignment. In this position, the support table 16 can be fastened, for example by means of a bolt, to the guide skid 15A. The part of the joint 32 on the support table 16 can, however, also be used to connect the support table to the trolley 12 at the joint 13.

As can be seen from the drawing, the support table 16 is provided with two joint parts 32 and 32' arranged one above the other, these parts being complementary to the joint parts 13' and 13" of the double joint 13. Thus, it is possible to use the support table 16 without the skid 15, in which case the joint parts 13' and 13" of the double joint 13 are connected to the joint parts 32 and 32'.

The joint parts 32 and 32' can, however, also be used to fix the support table 16 in different angular positions in relation to the skid 15. This is achieved by providing the support skid 15B with several parts, each of which can form part of the joint 30. These parts (only one of which, 30' can be seen in the drawing) are positioned at given spacings along the support skid 15B. The support table 16 can be attached, therefore, either to the joint part 30 or to any one of the parts such as 30', the strut 31 being of fixed length, thus varying the angle of inclination of the support table. Moreover, when the joint part 30' is used the joint parts 32 and 32' will, when the support 16 is laid flat, align with the double joint 13 instead of with the foot joint 33 so that the articulated connection of the double joint with the joint parts 32 and 32' can be effected without dismantling the skid 15. It is also possible to vary the angle of inclination of the support table 16 by varying the length of the strut 31, or by providing alternative joint parts on the support table and/or the guide skid 15A.

The anchoring of the anchor beam 10 in the head gallery K is effected by means of tie bolts in the form of chain sections 22 which are anchored in bore holes 23 in the gallery floor. Anchoring is effected, for example, by filling the bore holes 23 with a hardenable material 24 such as a quick-setting concrete.

On that side of the anchor beam 10 opposite to the support table 16 there are secured brackets 25 which are substantially fork-shaped in design. A respective bracket 25 is provided for each tie bolt 22 and a pair of open-ended bearings 26 for the accommodation of a pivot pin 27 whose ends are attached to the housing 28 of a device for tensioning the associated tie bolt. Thus, each housing 28 is mounted in its respective bracket 25 in such a way that it can pivot about the axis of its pivot pin 27, this axis extending parallel to that of the anchor beam 10. A connection element is slidably guided in the housing 28, this connection element being actuated by means of a projecting spindle 29 in order to impart initial stress to the tie bolt 22. It will be apparent that this pivotably mounted tie bolt tensioning apparatus can be adjusted within relatively wide limits to different inclinations of the tie bolt bores 23, and that the tensile forces in the tie bolts 23 are transmitted through the pivot joints 26, 27 of the tensioning apparatus.

We claim:

1. Apparatus for anchoring a mining installation to the floor of a mining working, the apparatus comprising an anchor beam, means for anchoring the anchor beam to the floor, a trolley mounted on the anchor beam for longitudinal movement relative thereto, a guide skid pivotally connected to the trolley, a support skid pivotally connected to the guide skid, a support table for supporting the mining installation, the support table being pivotally connected to the support skid for pivotal movement in a vertical plane, and a support strut pivotally connected to the support table and the guide skid.

2. Apparatus according to claim 1, wherein said means for anchoring the anchor beam is constituted by a plurality of tie bolts each of which is anchorable in a respective bore in the floor.

3. Apparatus according to claim 1, wherein the support table is provided with a carriage which is longitudinally displaceable relative thereto by at least one bracing ram, the carriage being connected to an anchor plate which supports the mining installation and is pivotally connected thereto.

4. Apparatus according to claim 1, wherein the guide skid is pivotally connected to the trolley by means of a double-link pivot joint.

5. Apparatus according to claim 1, wherein one end of the support strut is pivotally connected to the guide skid by means of a pivot joint positioned adjacent to the pivotal connection between the guide skid and the trolley.

6. Apparatus according to claim 5, wherein the other end of the support joint is pivotally connected to the support table by means of a pivot joint situated at one end of the support table.

7. Apparatus according to claim 6, wherein the support skid is pivotally connected to the support table by means of a pivot joint situated at the other end of the support table.

8. Apparatus according to claim 5, wherein said one end of the support table is provided with an attachment point for pivotal connection to the trolley.

9. Apparatus according to claim 1, wherein a plurality of spaced attachment points are provided on the support table for pivotal connection to the support strut.

10. Apparatus according to claim 9, wherein a plurality of spaced attachment points are provided on the guide skid for pivotal connection to the support strut.

11. Apparatus according to claim 1, wherein a plurality of spaced attachment points are provided on the guide skid for pivotal connection to the support strut.

12. Apparatus according to claim 1, wherein the length of the support table is substantially the same as the combined lengths of the guide skid and the support skid.

13. Apparatus according to claim 1, wherein the support skid is provided with a plurality of spaced attachment points for pivotal connection to the support table.

14. In apparatus for anchoring a mining installation to the floor of a mining working, the apparatus comprising an anchor beam, means for anchoring the anchor beam to the floor, a trolley mounted on the anchor beam for longitudinal movement relative thereto, skid means pivotally connected to the trolley, and a support table for supporting the mining installation, the support table being pivotally connected to said skid means for pivotal movement in a vertical plane, the improvement comprising forming said skid means by first and second skids pivotally connected together, the first skid being pivotally connected to the trolley and the second skid being pivotally connected to the support table, wherein the support table is held at any given inclination by means of a support strut pivotally connected to the support table and the first skid.

15. Apparatus for anchoring a mining installation to the floor of a mining working, the apparatus comprising an anchor beam, means for anchoring the anchor beam to the floor, a trolley mounted on the anchor beam for longitudinal movement relative thereto, a guide skid pivotally connected to the trolley, a support skid pivotally connected to the guide skid, a support table for supporting the mining installation, the support table being pivotally connected to the support skid for pivotal movement in a vertical plane, means for varying the angle of the support table, and a support strut pivotally connected to the support table and the guide skid.

* * * * *